United States Patent [19]

Focke

[11] Patent Number: 4,682,038

[45] Date of Patent: Jul. 21, 1987

[54] ARRANGEMENT FOR MONITORING AND CONTROLLING WEBS IN PACKAGING MACHINES

[75] Inventor: Heinz Focke, Verden, Fed. Rep. of Germany

[73] Assignee: Focke & Co., Verden, Fed. Rep. of Germany

[21] Appl. No.: 671,843

[22] Filed: Nov. 15, 1984

[30] Foreign Application Priority Data

Nov. 17, 1983 [DE] Fed. Rep. of Germany ..... 3341539

[51] Int. Cl.[4] ..... G01N 21/88

[52] U.S. Cl. ..... 250/548; 250/562; 250/571

[58] Field of Search ..... 250/202, 548, 571, 589, 250/562, 572

[56] References Cited

U.S. PATENT DOCUMENTS 4,284,356 8/1981 Heilman ..... 250/559
4,527,069 7/1985 Pfizenmaier ..... 250/548

FOREIGN PATENT DOCUMENTS 0010163 1/1977 Japan ..... 250/548

*Primary Examiner*—Gene Wan
*Attorney, Agent, or Firm*—Sughrue, Mion, Zinn, Macpeak & Seas

[57] ABSTRACT

During the monitoring of a web (10) especially a sheet of packaging material (foil), (photoelectric) sensors are used for monitoring the material and positioning. These are accommodated in or on a housing (12) which can be handled as an independent unit. Several monitoring systems for sensing different features of the web (10) or of a tear-open strip (25) are provided in the housing on both sides of a slit (13) open on one side.

7 Claims, 4 Drawing Figures

ARRANGEMENT FOR MONITORING AND CONTROLLING WEBS IN PACKAGING MACHINES

BACKGROUND OF THE INVENTION

1. Field of the Invention

The invention relates to an arrangement for monitoring and controlling webs of packaging material or the like in respect of material and positional defects, especially on packaging machines, with sensors, preferably photoelectric transmitters and receivers, for sensing the continuous web.

2. Description of Related Art

In connection with packaging machines, it is necessary to monitor webs of material, especially webs of packaging material. On the one hand, it is important to identify material defects, for example holes and tears, but also web joins made by adhesive tape, etc. When defects of this type are detected, one or more packs, especially cigarette packs, produced from the packaging material having these defects are separated out. However, it is also necessary, furthermore, to monitor the run of the web of material, that is to say its relative position. When there are deviations from the desired positions, the sheet is adjusted into the correct direction of movement by suitable adjusting members.

A monitoring and control arrangement of this type is described in EP-A-25,563. In this known proposal, a reel carrier has assigned to it a photoelectric sensing device which consists of two sensor bars arranged at a distance from one another. The web of packaging material runs through between these in such way that a row of sensors arranged at a slight distance from one another extends on each of the two sides of the web. Furthermore, there are on each sensor bar two lateral sensors (transmitter and receiver) which sense the side edges of the sheet and which detect any skewing. In the known device, these last-mentioned sensors or any error signals are used to actuate a servo-motor which correctly adjusts the reel or reel mounting.

Although the known arrangement is suitable for monitoring material and positional defects in a web of material, nevertheless it involves a relatively high outlay in terms of construction and handling.

SUMMARY OF THE INVENTION

The object on which the invention is based is to propose an arrangement for monitoring material and positional defects in or on webs, which is simple and inexpensive in terms of construction, but which is nevertheless reliable to operate.

To achieve this object, the arrangement according to the invention is defined by at least two sensors or groups of sensors, independent of one another, for sensing several material and production features of the web.

In the preferred embodiment of the invention, there are two groups of sensors which can be activated independently of one another. A first group of only two sensors, namely a transmitter and receiver, serves for monitoring the material quality of the web. In this case, the transmitter is preferably designed as a light tranmitter (infrared light transmitter) and the receiver is designed as a photodiode. The web is conveyed through between the transmitter and receiver, changes in the intensity of the received light being recorded by the receiver, for example thicker or thinner portions of material, tearing, adhesive tape for joining the ends of webs connected to one another, etc. The error signal generated by the receiver is used to separate out one or more packs from the region of the defective web.

According to the invention, a group of further sensors, in particular a transmitter and two receivers arranged at a distance from one another, serves for monitoring a strip of material (foil tear-open strip) applied to the web. In this case, the receivers are arranged at a distance from one another which is less than the width of the foil tear-open strip, so that the two receivers are covered by the latter. In the event that the strip deviates from the normal position, more light is supplied to one sensor or the other, and an error signal is derived from this.

According to the invention, this group of sensors has a further function, namely to monitor the relative position of the packaging blanks which, together with the strip of material, are severed from the web. For this purpose, each foil tear-open strip is provided with a marking (colored distinguishing mark) which is sensed in respect of its relative position by the sensors. A change in its position also means an undesirable change in the relative position of the blank.

According to a further proposal of the invention, these and, if appropriate, further sensors are arranged in or on a common unitary holder which is U-shaped. The sensors (transmitters and receivers) located opposite one another are arranged on (horizontally) directed legs, the web being conveyed through between the sensors in the region of a slit open on one side. These sensors are attached to a common U-shaped board as a carrier.

A monitoring arrangement designed in this way is simple to handle, in particular simple to assemble and, if necessary, exchange. The complete arrangement is designed as a saleable and handy unit.

Further features of the invention relate to the constructive design of the monitoring arrangement and to it members.

BRIEF DESCRIPTION OF THE DRAWINGS

Exemplary embodiments of the invention are explained in more detail below with reference to the drawings in which.

DETAILED DESCRIPTION OF A PREFERRED EMBODIMENT

Figure 1:
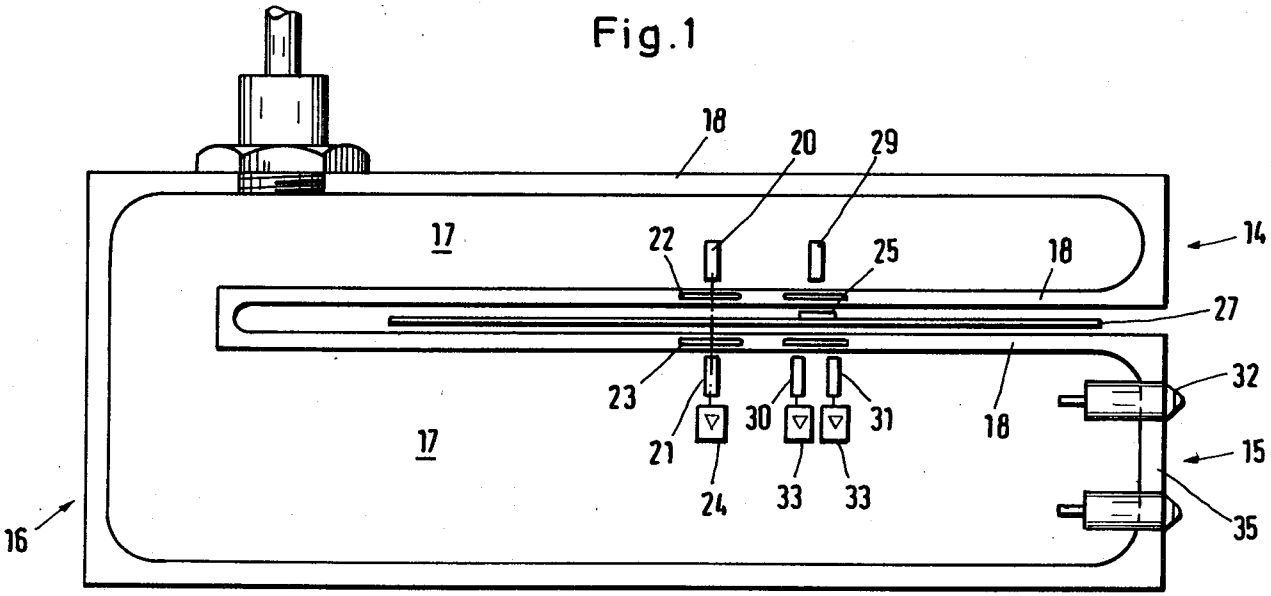
FIG. 1 shows, in a side view, a unit for monitoring webs, with monitoring members shown diagrammatically.
Figure 2:
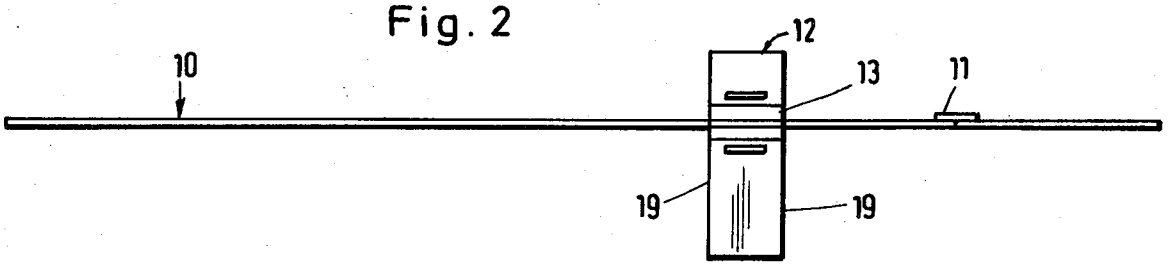
FIG. 2 shows the unit according to FIG. 1 in an end view, together with the web, on a reduced scale.

The exemplary embodiment of a monitoring and control unit, illustrated in the drawings, is particularly suitable in conjunction with packaging machines, preferably cigarette-packaging machines. A web 10 consisting, for example of a plastic foil and fed continuously to the packaging machine or a packaging unit (for example, a foil apparatus) is to be sensed as regards its relative position, defects, etc. The defects include irregularities in the material quality of the web 10 (holes, tears, undesirable thickened portions), as well as transverse adhesive tapes 11 for joining the ends of successive webs 10.

The monitoring arrangement consists of or is accommodated completely in a separate housing 12. This unit, which is approximately rectangular or cuboid in the present case, can be installed complete in or on the packaging machine and exchanged if necessary.

The housing 12 forms a slit 13 which is off-center here and which is open at one edge. By means of this slit, the housing 12 acquires an essentially U-shaped form with legs 14 and 15 and a cross-piece 16 connecting these to one another on one side. The web 10 runs through the slit 13 transversely to the longitudinal extension of the housing 12, preferably in a horizontal plane. The monitoring members, in particular optical or photoelectric sensors as well as indicator members and the electronic and electrotechnical devices, are accommodated in the U-shaped housing 12 or the housing designed with the slit 13 open on one side. The main carrier of these members is a board 17 which is U-shaped or designed with a slit 13. On the edge of this board, in particular following the contours, is formed a transverse wall 18 which extends all round. This also limits the slit 13 on both sides of the latter. Covering walls 19 which are part of the closed housing 12 are appropriately attached on the outside.

In the preferred exemplary embodiments illustrated here, the web 10 is sensed for any material defects by a first monitoring system which consists of a transmitter 20 on one side of the slit 13 and consequently of the web 10 and a receiver 21 on the other side. A test medium is emitted by the transmitter 20, preferably a pulsating infrared light which, after passing through the web 10, is received by the receiver 21. Changes in the radiation or light intensity result in an appropriate evaluation by evaluation electronics located after the receiver 21 and, if appropriate, in an error signal being generated. In the region of the (upper and lower) transverse wall 18, the infrared light is conveyed respectively through plane windows 22 and 23 within this transverse wall. An amplifier 24 is connected after the receiver 21.

Figure 3:
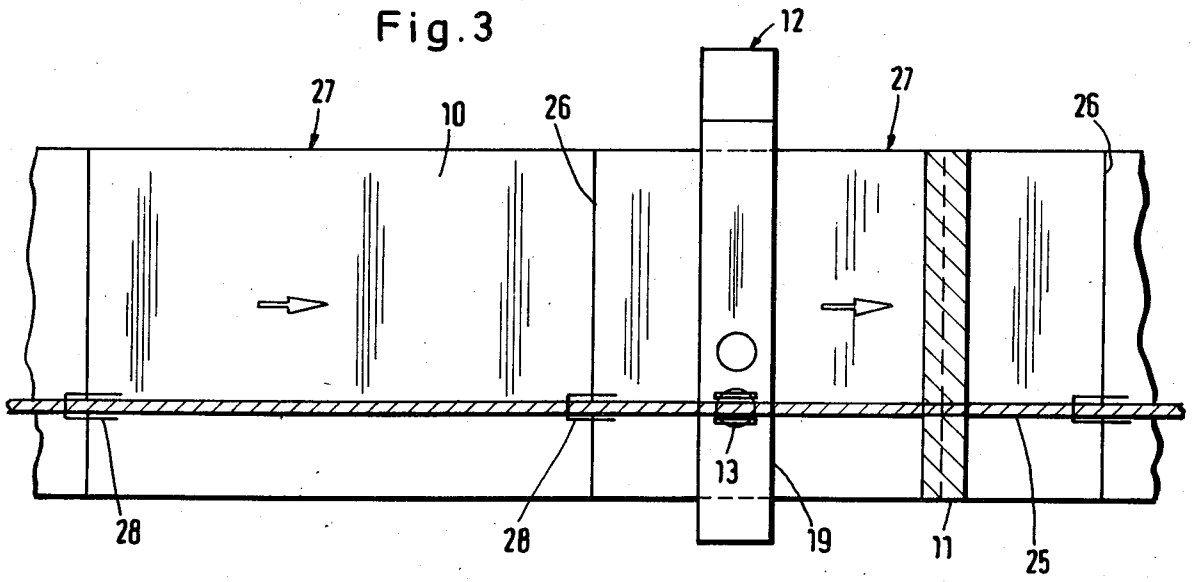
FIG. 3 shows a plan view relating to FIG. 2.
Figure 4:
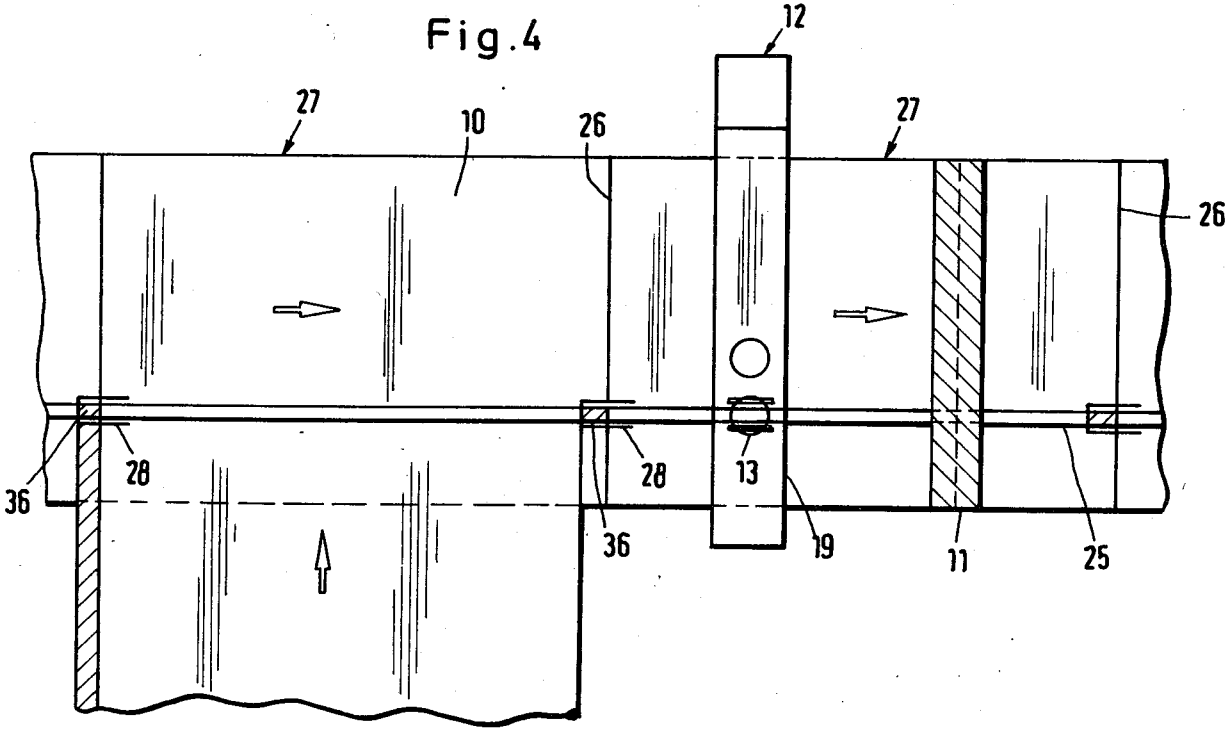
FIG. 4 shows an illustration corresponding to FIG. 3 and of another exemplary embodiment.

In the present exemplary embodiment, a strip of material, in particular a tear-open strip 25, attached (off-center) to the web 10 is monitored independently of the web 10. A tear-open sheet 25 of this type is customary on outer wrappers of packs, especially on the outer foil wrapper of cigarette packs. To clarify the illustrations in FIGS. 3 and 4, the web 10 is provided with imaginary transverse parting lines 26 defined by blanks 27, one for each pack, which are subsequently to be severed from the web 10. The tear-open strip 26 extends over the full length of the blanks 27 and consequently over the web 10. A prestamped gripping tab 28 for grasping the tear-open strip 25 when the pack is opened is marked at the end of each blank 27.

In the exemplary embodiment illustrated, the presence and exact relative position of the tear-open strip 25 are monitored by an independent system which consists of a common transmitter 29 and two receivers 30 and 31 arranged at a distance from one another. An amplifier 32 is located after each of the latter.

The receivers 30 and 31 are arranged at a distance from one another, for example, approximately 1 mm, which is somewhat less than the width of the tear-open strip 25. As a result, when the tear-open strip 25 is arranged in the normal position, the two receivers 30, 31 are covered by the latter or by the light beam. In the event of a deviation from the normal position, one receiver 30, 31 or the other receives infrared light directly, with the result that an error signal is triggered and a movement to correct the feed of the tear-open strip 25 initiated.

Optical indicator members 33 and 34, which here project from the housing 12 in the region of an end wall 35 of the latter, can be assigned to the two monitoring systems 20, 21, on the one hand, and 29, 30, 31, on the other hand. Any defect is (additionally) displayed by the indicator members 33, 34.

In the present case, the monitoring system with the transmitter 29 and receivers 30 and 31 performs a double function. For this purpose, the tear-open strip 25 is provided with a (colored) distinguishing mark 36, in the region of the gripping tab 28 in the exemplary embodiment of FIG. 4. In the present arrangement, this is used as an additional monitoring aid, specifically for the exact relative position of the blank 27, to be severed from the web 10, in relation to the pack (not shown) to be wrapped. For this purpose, the (colored) distinguishing mark 36 is sensed by the transmitter 29 or the receivers 30, 31. The result is evaluated in such a way that, in the event that a difference is detected in respect of the relative position, the conveying movement of the web 10 and consequently the relative positions of the blanks 27 are changed.

Because the monitoring systems are separated from one another, it is possible to adjust their sensitivity differently according to the monitoring objective. Furthermore, the connected adjusting devices of the packaging machine can be arranged and adjusted separately in terms of rapidity of action and the magnitude and direction of the set values.

The infrared light is generated periodically by the transmitters (2–5 khz), in order substantially to prevent the influences of extraneous light. During the sensing of the tear-open strip 25, the relative position of the members can be selected so that the receivers 30, 31 are each half-covered by the tear-open strip 25, that is to say supply approximately half their possible power. With the tear-open strip 25 running centrally, the initial values are set by the separate amplifiers 32 connected after each receiver 30, 31, so that they are approximately the same and the output signals do not indicate any defect. (Threshold-value setting according to the permissible tolerance deviation in a lateral direction.)

In this arrangement, the signals can be evaluated in various ways. When one of the amplifiers 32 or both of them emit an error signal, this can be transmitted as a defect to the output via an AND operation. Alternatively, each amplifier 32 can emit a different signal, for example positive voltage on the one hand and negative voltage on the other hand. The two signals are transmitted to a summing amplifier, the output of which is zero when the tear-open strip 25 is running in the proper way. As a result of hystereses, adjustable by means of a potentiometer, according to positive and negative values at the output, the permissible deviation of the tear-open strip 25 from the zero position can be set. At the same time, these positive and negative values can serve for readjusting the position of the tear-open strip via a correction control. Furthermore, the signals for separating out the defective packs or stopping the packaging machine are derived here.

What is claimed is:

1. In a packaging machine for packaging objects with a web which is passed along a path through said packaging machine, said web being divided into a plurality of blanks, said web further having an elongate tear-open strip running along the length of said web and along the path through which said web passes, a device for monitoring conditions of said web, said device comprising:

a first set of sensors for sensing a first set of characteristics of said web, said first of characteristics including material defects, and for accordingly providing a signal indicative of a material defect; and a second set of sensors for sensing a second set of characteristics of said web, different from said first set of characteristics, said second set of characteristics including positional orientation of said web with respect to said packaging machine, and for accordingly providing a signal indicative of mispositioning.

2. A device as claimed in claim 1, wherein said first set of sensors comprises transmitting means, positioned on one side of a path of said web, for transmitting light through said web, and receiving means, positioned on an opposite side of said path of said web from said transmitting means, for receiving the light emitted by said transmitting means, said receiving means including means for outputting said signal indicative of a material defect in accordance with variations in intensity of received light.

3. A device as claimed in claim 1, wherein said first set of sensors comprises first transmitting means, positioned on a first side of said web, for transmitting light through said web, and first receiving means, positioned on an opposite side of said web, for receiving the light transmitted by said first transmitting means, said first receiving means outputting said signal indicative of material defects in response to material defects detected in said web, said defects being detected in accordance with a difference in light intensity detected by said light receiving means.

4. A device as claimed in claim 1, wherein said second set of sensors comprises second transmitting means, positioned on one side of said web, for transmitting light through said web, and first and second receiving means, positioned on an opposite side of said web from said first transmitting means, for receiving the light transmitted by said light transmitting means, said first and second receiving means being positioned adjacent one another in a transverse direction of said web, said tear-open strip normally passing between said first and second receiving means along said path, said tear-open strip having a different light transmitting characteristic from said web, wherein positional orientation of said web with respect to said packaging machine is detected in accordance with the light intensities detected by said first and second receiving means, said first and second receiving means outputting said indicative of mispositioning in accordance with a difference in the respective light intensities, said difference varying in accordance with a position of said tear-open strip with respect to said first and second receiving means.

5. A device as claimed in claim 1, wherein said second set of sensors comprises transmitting means, positioned on one side of a path of said web, for transmitting light through said web, first receiving means positioned on an opposite side of said path from said transmitting means, for receiving light transmitted by said transmitting means through said web, and second receiving means, positioned on the same side of said web as said first receiving means, for receiving light transmitted by said transmitting means through said web, said first and second receiving means including means for outputting said signal indicative of mispositioning in accordance with a difference in respective intensities of light received by said first and second receiving means.

6. A device as claimed in claim 5, wherein said means for outputting said error signal includes means for comparing respective intensities of light received by said first and second receiving means and for outputting an error signal if the intensities are different.

7. A device as claimed in claim 5, wherein said first receiving means outputs a signal having a first intensity and a first polarity, said second receiving means outputs a signal having a second intensity and a second polarity, said means for outputting an error signal including means for adding the outputs of said first and second receiving means and obtaining a sum, and outputting an error signal if the sum is not zero.

* * * * *